US007240813B1

(12) United States Patent
Goldman

(10) Patent No.: US 7,240,813 B1
(45) Date of Patent: Jul. 10, 2007

(54) TOP SIZER FOR A HANGER

(75) Inventor: Stuart Goldman, Wayne, NJ (US)

(73) Assignee: Uniplast Industries, Inc., Hasbrouck Heights, NJ (US)

( * ) Notice: Subject to any disclaimer, the term of this patent is extended or adjusted under 35 U.S.C. 154(b) by 0 days.

(21) Appl. No.: 11/421,003

(22) Filed: May 30, 2006

(51) Int. Cl.
*A41D 27/22* (2006.01)

(52) U.S. Cl. ..... 223/88; 223/85; 40/322

(58) Field of Classification Search ..... 223/85, 223/87, 88, 92, 95, 96, 97, 98; 40/322; 206/281; 211/113; 248/339, 340; D6/328
See application file for complete search history.

(56) References Cited

U.S. PATENT DOCUMENTS

| | | | | | |
|---|---|---|---|---|---|
| 1,389,266 | A | * | 8/1921 | Newton | 40/322 |
| 1,544,844 | A | * | 7/1925 | Levkowits | 40/5 |
| 1,575,775 | A | * | 3/1926 | Lesser | 40/322 |
| 2,690,863 | A | * | 10/1954 | Adelman | 40/322 |
| 3,535,808 | A | * | 10/1970 | Morrish | 40/322 |
| 3,790,044 | A | * | 2/1974 | Verdile | 223/86 |
| 3,898,754 | A | * | 8/1975 | Johansson | 40/322 |
| 4,045,899 | A | * | 9/1977 | Richardson | 40/322 |
| 4,123,864 | A | * | 11/1978 | Batts et al. | 40/322 |
| 4,198,773 | A | * | 4/1980 | Batts et al. | 40/322 |
| 4,322,902 | A | * | 4/1982 | Lenthall | 40/322 |
| 4,333,590 | A | * | 6/1982 | Princiotta | 223/85 |
| 4,679,340 | A | * | 7/1987 | Johansson | 40/322 |
| 4,881,836 | A | * | 11/1989 | Blanchard | 40/322 |
| 5,388,354 | A | | 2/1995 | Marshall et al. | |
| 5,499,466 | A | * | 3/1996 | House | 40/322 |
| 5,503,310 | A | | 4/1996 | Zuckerman et al. | |
| 5,628,132 | A | | 5/1997 | Marshall et al. | |
| 5,775,553 | A | | 7/1998 | Marshall et al. | |
| 5,794,363 | A | | 8/1998 | Marshall et al. | |
| 5,857,276 | A | | 1/1999 | Marshall et al. | |
| 5,884,422 | A | | 3/1999 | Marshall et al. | |

(Continued)

OTHER PUBLICATIONS

U.S. Appl. No. 29/245,826, Goldman.

(Continued)

*Primary Examiner*—Gary L. Welch
*Assistant Examiner*—Nathan E Durham
(74) *Attorney, Agent, or Firm*—Darby & Darby

(57) ABSTRACT

A top sizer for use with a garment hanger including a hollow body having an open bottom and a top wall that has a first opening formed therein that provides communication to the hollow interior. The top sizer includes a locking feature associated therewith that is configured to permit the top sizer to be releasably engaged and secured to the hook member. The locking feature is formed above the first opening, wherein the locking feature has a slot that defines a pair of opposing resilient locking tabs. The slot is defined by an open end portion (entrance) and an inner portion that has a width greater than the open end portion, with free ends of the locking tabs and the open end of the slot being in communication with the first opening to permit a hook member of the garment hanger that is in the first opening to be received into the open end of the slot and then into the inner portion once a biasing force of the locking tabs is overcome resulting in the hook member being captured in the inner portion and the top sizer being locked relative to the garment hanger.

20 Claims, 5 Drawing Sheets

U.S. PATENT DOCUMENTS

| | | | | | |
|---|---|---|---|---|---|
| D421,683 | S | * | 3/2000 | Willardson | D6/328 |
| D421,848 | S | * | 3/2000 | Willardson | D6/328 |
| D421,850 | S | * | 3/2000 | Willardson | D6/328 |
| D422,153 | S | * | 4/2000 | Willardson | D6/328 |
| D423,798 | S | * | 5/2000 | Willardson | D6/328 |
| D424,818 | S | * | 5/2000 | Willardson | D6/328 |
| D430,410 | S | * | 9/2000 | Willardson | D6/328 |
| D445,836 | S | * | 7/2001 | Willardson | D20/28 |
| 6,726,067 | B2 | | 4/2004 | Louw et al. | |
| 6,883,259 | B2 | * | 4/2005 | Johansson | 40/322 |
| D505,275 | S | * | 5/2005 | Wooten | D6/323 |
| D510,198 | S | * | 10/2005 | Willardson | D6/328 |
| D528,807 | S | * | 9/2006 | Mainetti | D6/328 |
| 2006/0006204 | A1 | * | 1/2006 | Mainetti | 223/85 |
| 2006/0213938 | A1 | * | 9/2006 | Gouldson | 223/85 |
| 2006/0213939 | A1 | * | 9/2006 | Gouldson | 223/85 |

OTHER PUBLICATIONS

U.S. Appl. No. 29/262,968, Goldman.
U.S. Appl. No. 11/321,728, Goldman.

* cited by examiner

TOP SIZER FOR A HANGER

TECHNICAL FIELD

The present invention relates to a garment hanger of the type which includes a locking information clip and more particularly, to a top sizer clip for use with a garment hanger and one which is adapted to fit on most hangers/hook members.

BACKGROUND

There are a number of different types of garment hangers that are used to hold a number of different articles of clothing or other types of articles, such as linens or other household fabrics. Typically, garment hangers are either formed of a plastic material or a metal material or a combination thereof. Not only do garment hangers come in a variety of different sizes but they also come in a number of different styles that have different types of construction to accommodate different articles which are carried by the hangers.

For example, one type of garment hanger construction is designed to secure knitwear, blouses, slips, strapped garments, including dresses and lingerie. Another type of garment hanger construction is designed to also secure blouses, dresses and other light garments, while another type of garment hanger is designed to secure heavier knitwear, blouses, pants and light weight pant suits. Yet another type of garment hanger is designed to secure coats, jackets and outerwear. The foregoing types of garment hangers can be generally classified as being top garment hangers, while another class of garment hangers is pant hangers, which are those hangers that are designed to secure pants, skirts, and other outfits together. Often times, pant hangers incorporate some type of clamp mechanism to securely grasp and hold the articles of clothing. One will appreciate that there are even more types of garment hangers (e.g., bra/panty hanger) that are intended for particular applications.

One accessory that is often used with a hanger is a size indicator that typically is a small plastic part that attaches to the body of the hanger and has indicia formed thereon that indicates the size or some other identifying mark of the article of clothing that is being held on the hanger. The size indicator can either take the form of a side sizer, where the clip (sizer) attached to the side of a hook member or a top sizer, where the clip attaches more to the top of the hook member.

Conventional top sizer clips are most times custom designed for a specific type or style of hanger (i.e., a matching hanger) and therefore, when they are used with other hangers, the clips tend not to be secured to the hanger but instead either are too small so that they can not be received on the base structure or they are too large and therefore, they wobble on the base structure and can easily become disengaged and fall off the hanger. By not having a secure attachment between the clip and the hanger, the size indicators do not perform their full intended function and instead can easily become misplaced and replacement thereof can result in the wrong size indicator being placed on the hanger which in turn can result in the wrong article of clothing being selected by a consumer or if no size indicator is present, the consumer may rummage through the clothing and leave an untidy display in order to find the proper size.

SUMMARY

In one aspect of the present invention, a top sizer is provided for use in combination with a garment hanger having a body and a hook member. The top sizer includes a hollow body having an open bottom and a top wall that has a first opening formed therein that provides communication to the hollow interior and a locking feature associated therewith. The locking feature is in communication with the first opening, wherein the locking feature has a slot that defines a pair of opposing resilient locking members. The top sizer is slideably movable in a lateral direction across the garment hanger body between an unlocked position where the hook member is outside the slot and a locked position wherein the hook member is captured within the slot and is held therein due to the locking members being biased inwardly toward one another. The slot has a variable width that is at a minimum at an entrance into the slot and an inner portion where a width of the slot is at a maximum such that the width of the entrance is less that a width of the hook member to prevent free travel of the hook member into and out of the slot.

A top sizer for use with a garment hanger including a hollow body having an open bottom and a top wall that has a first opening formed therein that provides communication to the hollow interior. The top sizer includes a locking feature associated therewith that is configured to permit the top sizer to be releasably engaged and secured to the hook member. The locking feature is formed above the first opening, wherein the locking feature has a slot that defines a pair of opposing resilient locking tabs. The slot is defined by an open end portion and an inner portion that has a width greater than the open end portion, with free ends of the locking tabs and the open end of the slot being in communication with the first opening to permit a hook member of the garment hanger that is in the first opening to be received into the open end of the slot and then into the inner portion once a biasing force of the locking tabs is overcome resulting in the hook member being captured in the inner portion and the top sizer being locked relative to the garment hanger.

Other features and advantages of the present invention will be apparent from the following detailed description when read in conjunction with the accompanying drawings.

BRIEF DESCRIPTION OF THE DRAWING FIGURES

The foregoing and other features of the present invention will be more readily apparent from the following detailed description and drawings figures of illustrative embodiments of the invention in which.

DETAILED DESCRIPTION OF PREFERRED EMBODIMENTS

Figure 1:
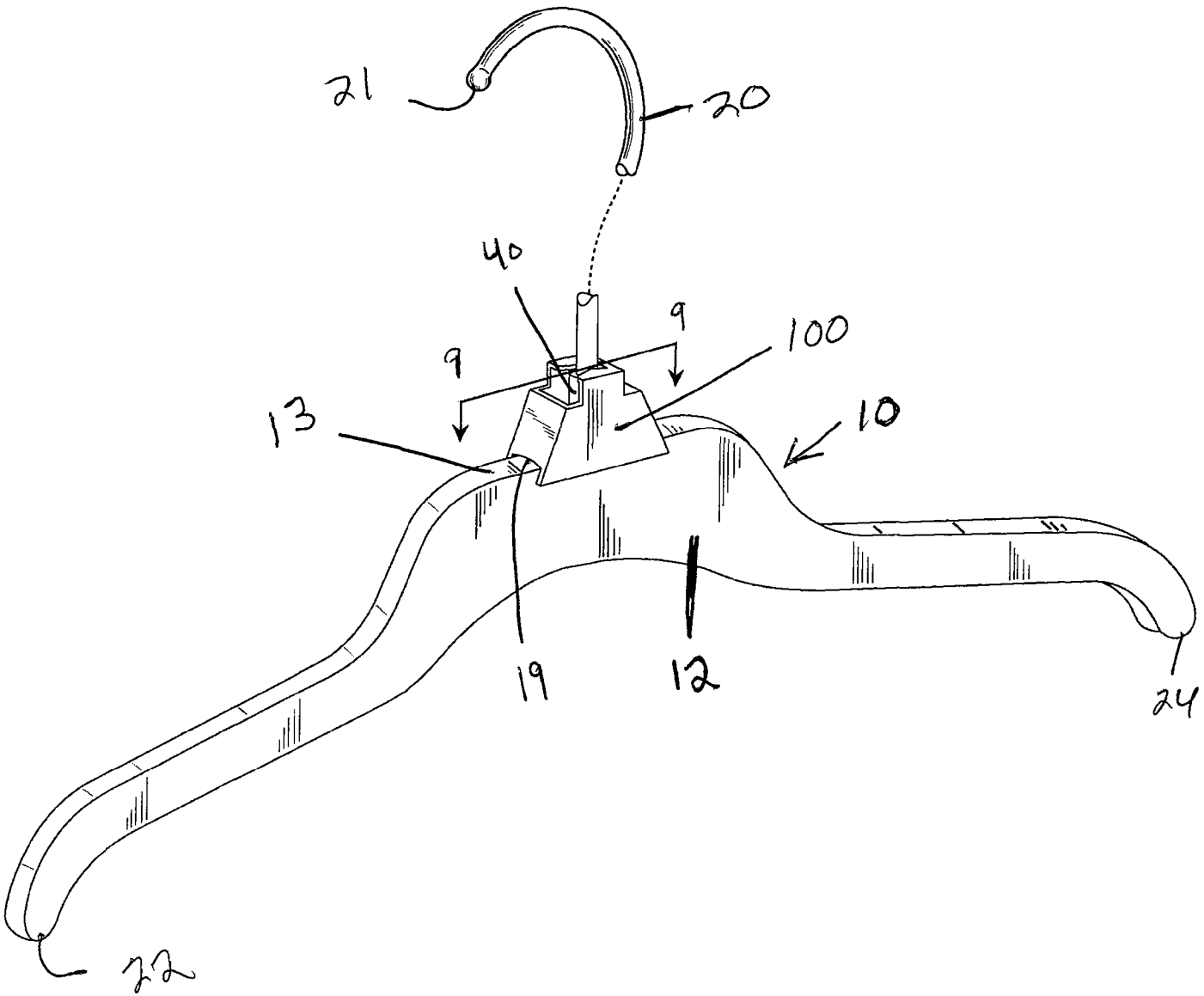
FIG. 1 is a perspective view, partially broken away, of a conventional garment hanger with a top sizer according to the present invention attached thereto.
Figure 2:
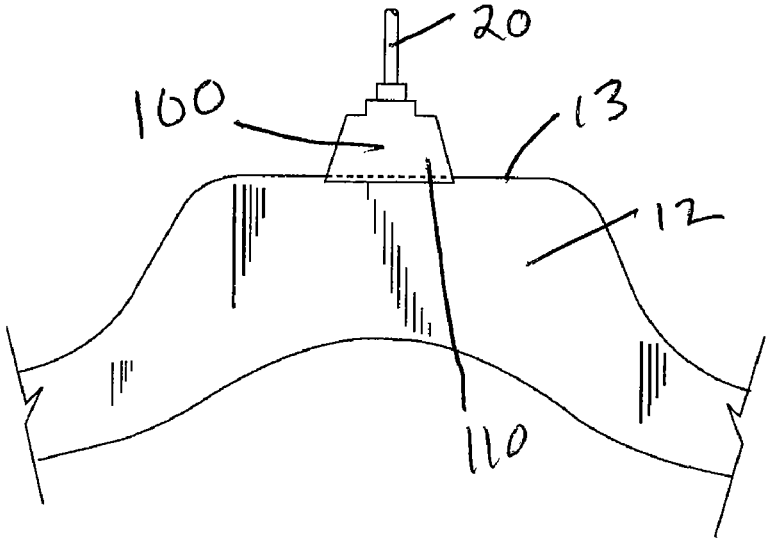
FIG. 2 is a partial side elevation of the hanger and top sizer of FIG. 1 being attached to a hook holder of the hanger.

FIG. 1 is a perspective view, partially broken away, of a conventional garment hanger 10 that includes a body portion 12 (cross bar) having two opposing ends 22, 24 and a hook member 20 that is attached to the body portion 12. A top sizer (indicator or crown sizer) 100 according to the present invention is shown attached to the hook member 20. The exemplary garment hanger 10 is of the type that can include a clamp or grip assembly formed near or at each of the first and second ends 22, 24. The grip assemblies are integrally formed with body portion 12 at the first and second ends 22, 24. The article of clothing can be placed within the grip assembly. FIG. 2 is a side elevation view of the hanger 10 with the top sizer indicator 100 being attached thereto. It will be appreciated that the top sizer indicator 100 can be formed of either an opaque material or transparent material, etc.

The body portion 12, including any grip assemblies, is preferably made as a single piece, molded in plastic using a plastic injection molding machine, as understood by those skilled in the art. Any appropriate plastic can be used, such as styrene, which provides a clear, virtually transparent hanger and alternatively, the hanger 10 can be molded using polypropylene, such as H.I. styrene polypropylene, polypropylene, polyvinylchloride, ABS or other suitable thermoplastics and/or mixtures thereof. As understood by those skilled in the art, the plastic mixture used to mold the hangers can include additional resins for added strength and reinforcement.

The illustrated garment hanger 10 is of a swivel hook type construction in that the hook member 20 is swivably or pivotally attached to the body portion 12 at a location that is generally at a midpoint along the body portion 12. The hook member 20 is pivotally received within a bore that is formed in a base structure 40 that is integrally attached at one end to an upper edge 13 of the body portion 12. The bore therefore has a complementary shape as the hook member 20 and thus, for the illustrated embodiment, the bore is annular in shape to complement the circular shape of the hook member 20. The overall shape of the base structure 40 is not critical and it can assume any number of different shapes. For example, while the illustrated base structure 40 has a circular cross-section, it will be appreciated that the base structure 40 can have a number of different shapes, such as rectangular or square, oblong, etc. The hook member 20 is thus frictionally fit within the bore; however, it is permitted to swivel freely therein when a user applied a force to the hook member 20 to produce such movement.

According to the present invention, the base structure 40 includes first and second side elements that extend outwardly therefrom and are integral with the body portion 12. More specifically, each of the first and second side elements has a first end that is integrally connected to the base structure 40 and an opposing second end that is integrally connected to the upper edge 13 of the body portion 12. The precise connection points between the first ends and the base structure 40 and the second ends and the body portion 12 can vary.

In the illustrated embodiment, the first and second side elements are elongated, planar walls that extend from the upper edge 13 to an upper end of the base structure 40. The width of the first and second side elements and the base structure 40 is preferably the same or about the same. An angle is thus formed between each of the first and second side elements and the upper edge 13. In this embodiment, a space formed between one side element and the base structure 40 is generally triangular shaped. The first and second elements do not have to have a linear, planar construction, as it will be appreciated that the first and second side elements can have an arcuate shape. In other words, the first and second side elements can have a curved surface resulting in space having an irregular space.

A free end of the hook member 20 can include a curled or bent end or ball-like structure 21 that will be described in more detail below with reference to the reception of the top sizer 100 on the hook member 20. In any event, the free end of the hook member 20 typically has an enlarged section relative to the adjacent length of the hook member 20.

FIGS. 1-9 illustrate the top sizer 100 according to one embodiment of the present invention. The top sizer 100 is formed of a body 110 that is essentially hollow and is defined by a first side wall (front wall) 112, an opposing second side wall (rear wall) 114, a first end wall 116, an opposing second end wall 118, and a top wall 120. The bottom of the top sizer 100 is open so as to permit the top sizer 100 to be inserted over the hook member 20 and then securely attached to the hanger 10 as described below.

While the top sizer 100 can be formed of any number of different materials, the top sizer 100 is typically made from a plastic material using conventional techniques, such as molding techniques, e.g., injection molding. The top sizer 100 can be either opaque in nature or semi-transparent or transparent and can be formed to have any number of different colors.

Figure 3:
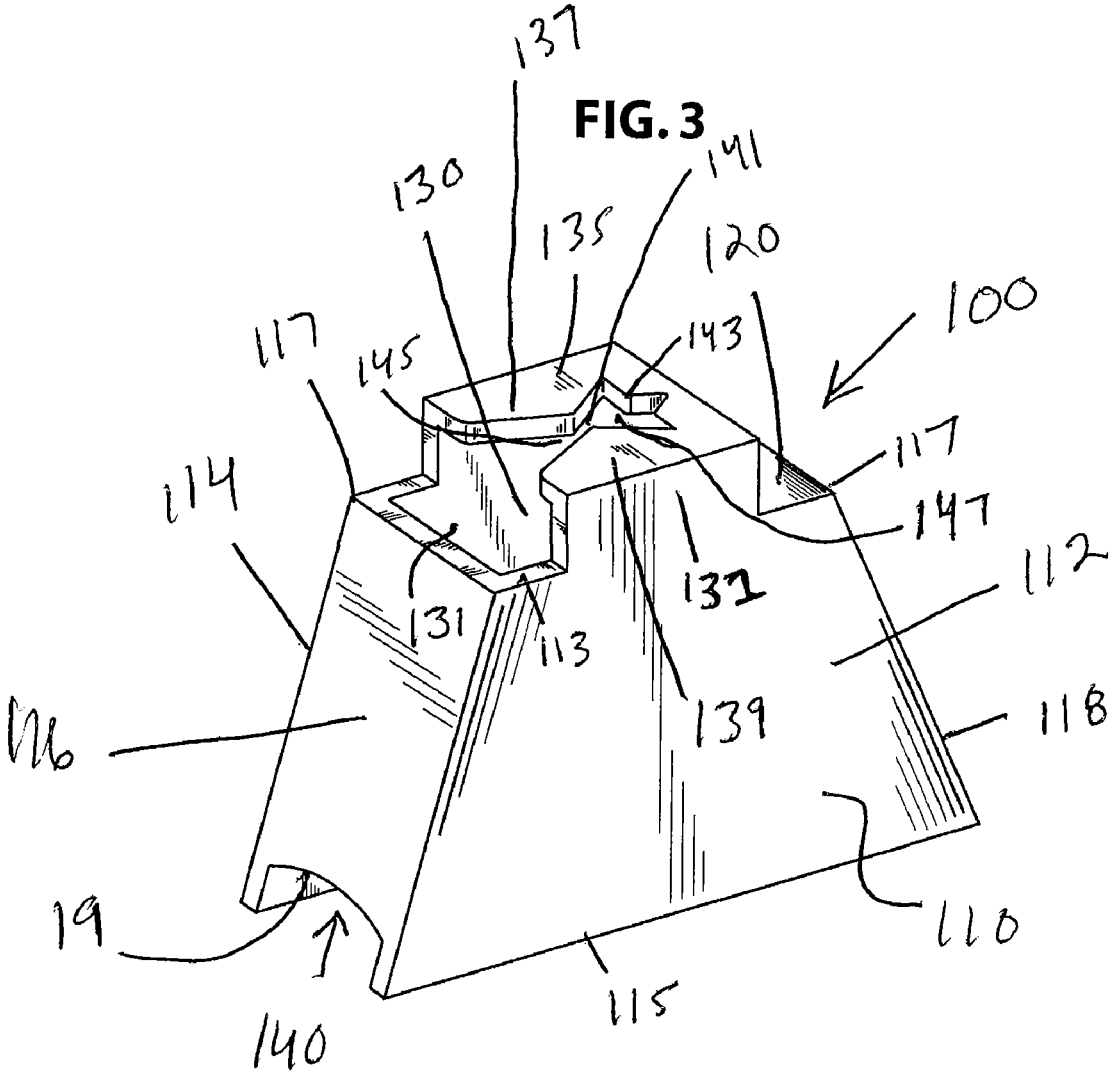
FIG. 3 is a front perspective view of the top sizer according to the present invention.
Figure 4:
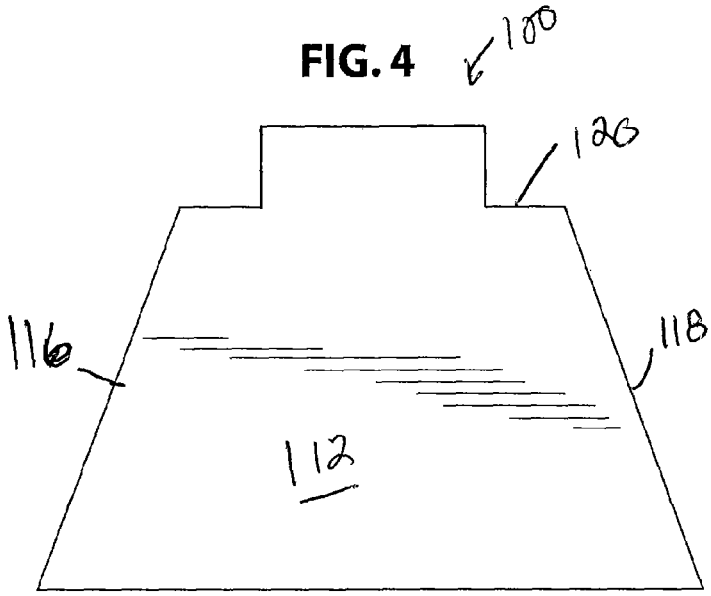
FIG. 4 is a front elevation view of the top sizer of FIG. 3.
Figure 5:
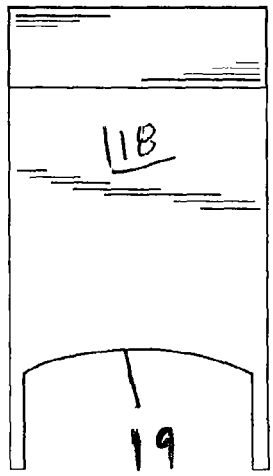
FIG. 5 is a right side view (end view) of the top sizer of FIG. 3.
Figure 6:
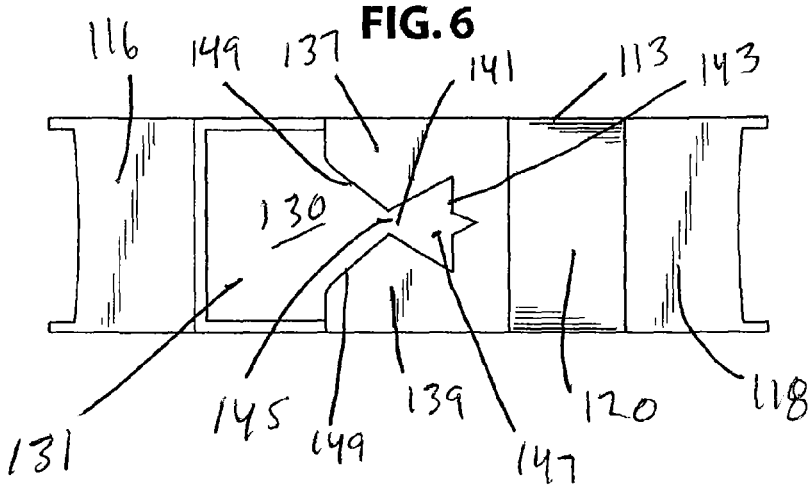
FIG. 6 is a top plan view of top sizer of FIG. 3.
Figure 7:
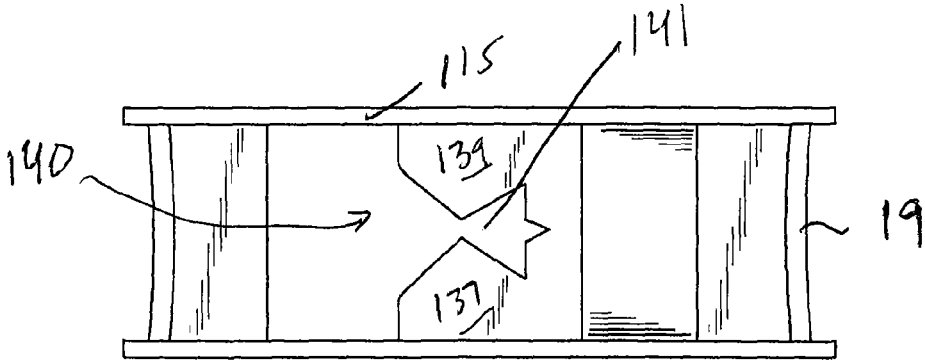
FIG. 7 is a bottom plan view of the top sizer of FIG. 3.

As best shown in FIGS. 2-4, each of the first and second side walls 112, 114 has a substantially parallelogram shape in that top and bottom edges 113, 115, respectively, thereof are parallel and the two end walls 116, 118 join the side walls 112, 114 at an angle such that the ends are beveled walls with respect to a ground surface (bottom edge 115). The end walls 116, 118 extend between the two side walls 112, 114 and are joined at their top edges 117 to the top wall 120. The end walls 116, 118 can have any number of different shapes; however, the walls 116, 118 typically have either a square or rectangular shape.

The top wall 120 is joined along its edges to the side walls 112, 114 and the end wall 118. It will be appreciated from the drawing figures that the top wall 120 does not extend completely from end wall 116 to end wall 118. The top wall 120 includes an opening 130 that is formed therethrough and provides an entrance into an interior 140 of the top sizer clip 100. The opening 130 extends from the inner edge of the top wall 120 to the other end wall 116. In other words, the opening 130 is formed adjacent an upper edge of the other end wall 116.

The top wall 120 includes a locking feature 135 that is formed with the top wall 120 and communicates with and is associated with the opening 130. More specifically, the feature 135 is in the form of a raised structure or protrusion that extends outwardly from the inner edge of the top wall 120 and from the side walls 112, 114 and at least partially encloses the opening 130.

The locking structure 135 is a hollow structure that is defined by three walls 131 and is open toward the end wall 118. As best shown in the side elevation view, the locking structure 135 is formed generally in the middle region of the upper edge 13 of each side wall 112, 114, with the top wall 120 being formed between one end of the locking structure 135 and the end wall 116 and the opening 130 being formed between the other end of the locking structure 135 and the other end wall 118.

The locking structure 135 is constructed so as to form two locking tabs or flanges or fingers 137, 139 with a slot 141 formed between the two locking tabs 137, 139. By forming a slot 141, not only are the locking tabs 137, 139 defined but flexibility is imparted to the locking tabs 137, 139 to permit the locking tabs 137, 139 to slightly separate further apart, under an applied force, so as to permit an object to be received within the slot 141.

The slot 141 has a varying width and extends from one end of the locking structure 135 to a closed end 143. An open end (entrance) 145 of the slot 141 has a width that is less than a width in an inner portion 147 of the slot 141. The inner portion 147 of the slot 141 has edges that taper outward so as to cause an increasing slot width. The open end 145 thus forms an entrance into the slot 141. Outer edges 149 of the locking tabs 137, 139 are preferably angled inward toward the entrance of the slot 141 to assist and guide an object into the slot 141. If an object contacts one or both of the outer edges 149, the object ridges along the edges 149 into the slot 141 where it can then advance further toward and into the wider inner portion 147. Since the locking tabs 137, 139 have a degree of resiliency or flexibility, the insertion of an object into the narrower entrance 145 of the slot 141 causes the locking tabs 137, 139 near the entrance 145 to separate and flex outwardly to permit the object to be received within the inner portion 147 that has a greater width compared to the entrance 145. Once the object is received within the inner portion 147 of the slot 141, the locking tabs 137, 139 flex back to their normal, rest positions due to their resilient nature. Once the locking tabs 137, 139 flex back to their original states, the object contained in the inner portion 147 is effectively locked in place since it cannot freely travel through the narrower entrance 145.

The outer edges 149 do not extend completely to the upper edge of the end wall 118 and therefore a portion 131 of the opening 130 defines an open slot or space into which an object can be inserted into the interior of the body 110.

An inner surface 150 of the body 100 is preferably smooth to permit reception and movement of an objection that is inserted into the interior of the body 110. For example, the hook member 20 is received in the interior of the body 100.

The process of securely attaching the top sizer 100 to the hanger 10 and more particularly, the hook member 20, is now described. The top sizer 100 is first aligned relative to the hanger 10 by inverting the top sizer 100 relative to the hanger 10. As described below, depending on the type of hook member 20 and the shape thereof, the top sizer 100 may need to be manipulated (rotated) in order to align the opening portion 131 and the hook member 20.

In particular and in the case of hook member 20 with a curled (bent) end, the top sizer 100 is positioned at approximately a right angle as measured from one end to the other end of the hanger 10 and along a width of the top sizer 100 from end wall 16 to end wall 18. In other words, the inverted top sizer 100 is positioned so that the length of the portion 131 of the opening 130 is generally aligned with the curled end of the hook member 20. The curled end of the hook member 20 is then introduced into the interior 140 of the body 110 of the top sizer 100. The width of the curled end of the hook member 20 is then slightly less than the distance (width) between the side walls 112, 114 to allow the curled end to be received between the side walls 112, 114.

The curled end of the hook member 20 is then advanced within the interior 140 of the body 110 such that the curled end overlies and is aligned with the portion 131 of the opening 130 and until the curled end of the hook member 20 is received within the portion 131 of the opening 130. As the curled end is advanced into and passes through the portion 131 of the opening 130, the curled end seats against or is in close proximity to outer edges 149 of the locking tabs 137, 139. The curled end is thus positioned between the locking tabs 137, 139 and the upper edge 117 of the end wall 116.

The body 110 is then moved along the hook member 20 until the entire curled end of the hook member 20 clears the top wall 120 of the body 110 at which time the narrower hook member 20 portion defined by a single rod or wire structure of the hook member 20 is received into the portion 131 of the opening 130. At this time once the curled end has passed through the top wall 120 of the body 110, the top sizer 100 can freely rotate about the hook member 20 as it travels down the hook member 20 toward the base structure 40 and toward the upper edge 13 of the body portion 12.

In the case when the free end of the hook member 20 is defined by the ball-like structure 21, the ball-like structure 21 is merely inserted into the portion 131 of the opening 130 without regard to how the body 110 is orientated relative to the ball-like structure 21 unlike the case when the free end is in the form of the bent or curled end.

The shape and dimensions of the interior 140 of the body 110 of the top sizer 100 are selected so as to permit the reception of the base structure 40 therein so as to permit the top sizer 100 to be disposed about the base structure 40, with the bottom edge of the top sizer 100 being disposed proximate to the upper edge 13 of the body portion 12 (as well as being substantially parallel thereto).

The end walls 116, 118 thus face the beveled walls of the base structure 40 as the body 110 is advanced to toward the upper edge 13. In yet another aspect of the present invention, the bottom edges of the end walls 16, 18 are not defined by straight edges but instead are defined by arcuate shaped bottom walls 19. More specifically, the formation of cutouts in the end walls 16, 18 to define the arcuate shape causes the side walls 12, 14 to be flexible at least near the ends portions of the side walls 12, 14. In particular, when an object, such as the body portion 12, is received between the side walls 12, 14, these walls flex outwardly due to the width of the body portion 12 being greater than the distance between the side walls 12, 14 in their relaxed, normal state. Since the body 110 is preferably formed of a resilient material (e.g., a plastic), once the applied force (i.e., the body portion 12) is removed from the position between the side walls 12, 14, the walls flex inward to resume their relaxed, normal position.

The top sizer 100 is directed down over the base structure 40 until its bottom edge contacts or is close to the upper edge 13 of the body portion 12 of the hanger 10 and in this case, the arcuate shaped bottom walls 19 seat against the upper edge 13 which has a complementary shape. Lateral movement of the top sizer 100 is still possible at this point along the upper edge 13.

According to the present invention, the top sizer 100 is moved between an unlocked position and a locked position by lateral movement of the top sizer 100 along the upper edge 13 so as to cause engagement of the locking feature 135 with the hook member 20 in a manner that causes the top sizer 100 to become locked in place on the hanger 10. When the top sizer 100 is inserted onto the hook member 20, the open end 145 of the slot 141 faces the hook member 20. To lock the top sizer 100 to the hook member 20, the body 110 of the top sizer 100 is moved laterally toward the hook member 20 to cause the hook member 20 to enter the open end 145 (entrance) of the slot 141. Since the width of the open end 145 (the distance between the locking tabs 137, 139 at the slot entrance) is less than the width (diameter) of the hook member 20, the insertion of the hook member 20 into the slot 141 causes the locking tabs 137, 139 to separate outwardly to permit reception of the hook member 20 therein. This outward flexing is possible, as previously mentioned, due to the formation of the slot 141 to create the flexing action in the locking tabs 137, 139.

As the top sizer 100 is moved laterally along the upper edge 13, the hook member 20 is advanced further into the slot 141 and in particular, the hook member 20 moves into the wider inner portion 147 of the slot 141. The inner portion 147 has a width (defined by the distance between the locking tabs 137, 139 that is about equal to or greater than the width (diameter) of the hook member 20 and therefore, once the hook member 20 is received into the inner portion 147, a force is no longer applied to the locking tabs 137, 139 in an outward direction that causes the locking tabs 137, 139 to separate from one another. In other words, the applied force is removed and therefore, the locking tabs 137, 139 return to their normal, relaxed states so as to capture the hook member 20 within the wider inner portion 147. This causes the open end 145 of the slot 141 to now have a width that is less than the width of the hook member 20 and therefore, the hook member 20 can not simply move out of the slot 141 in a free manner since the normal inward biasing forces of the resilient locking tabs 137, 139 is greater than any force generated by the hook member 20 within the inner portion 147 during normal use. Once the top sizer 100 is captured in the inner portion 147, it is effectively in the "locked position"

The reception of the hook member 20 into the inner portion 147 is confirmed with an auditory signal in the form of a click so as to alert the user that the top sizer 100 is effectively in the locked position on top of the hanger 100. It is also confirmed by a vibratory or sensory motion or sensing action through the body 110 as it spreads the locking tabs 137, 139 apart until it enters the inner portion 147 at which time the locking tabs 137, 139 snap back into place in the relaxed position so as to capture the hook member 20 in the inner portion 147. The snapping action felt by the user, as well as the snapping noise, as the top sizer 100 is moved laterally along the upper edge 13 provide signals to the user that the top sizer 100 is effectively placed in the locked position.

The top sizer 100 can be removed from the hanger 100 by simply reversing the process and in particular by moving the top sizer 100 in the opposite lateral direction along the upper edge 13. The top sizer 100 is removed by simply moving the top sizer 100 along the upper edge 13 in a direction away from the hook member 20. When the top sizer 100 is moved in this direction along the upper edge 13, the hook member 20 begins to move from the inner portion 147 toward the free end 145 where the hook member 20 encounters resistance due to the width (diameter) of the hook member 20 being greater than the width of the end 145 of the slot 141. This resistance is due to the natural inward biasing force of the locking tabs 137, 139 and until the biasing force is overcome, the hook members 20 can not travel to the end 145. However as the user applies a force to the body 110, the locking tabs 137, 139 are spread apart, thereby permitting the hook member 20 to be received into the end 145 of the slot 141. Once the locking tabs 137, 139 are spread apart sufficiently, the hook member 20 is received in the slot 141 and can travel through the end 145 of the slot 141 and then ultimately clear the locking tabs 137, 139 at which time, the top sizer 100 is fully disengaged from the hanger 10 and can be removed therefrom as when the user needs to change the top sizer 100 or otherwise remove the top sizer 100.

Figure 10:
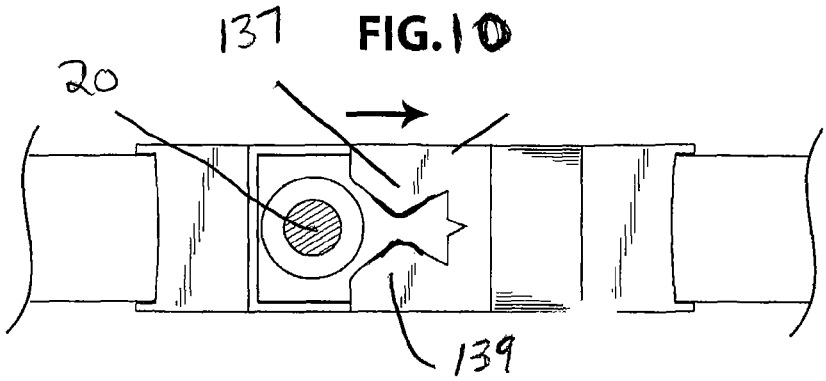
FIG. 10 is a cross-sectional top plan view showing the hook member in a disengaged position relative a top sizer according to another embodiment.
Figure 11:
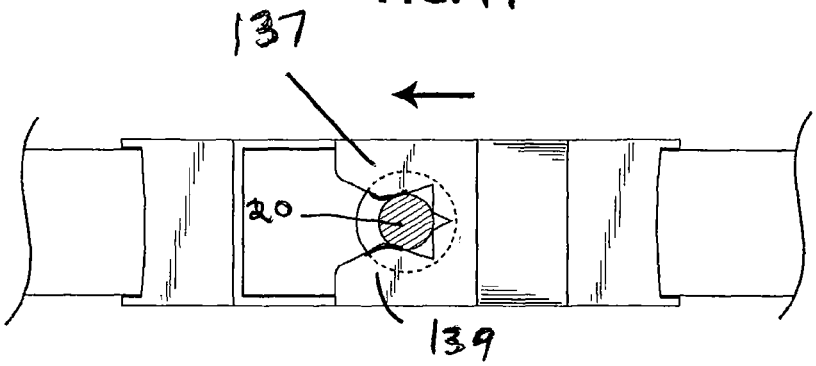
FIG. 11 is a cross-sectional top plan view of the top sizer of FIG. 10 locked in place relative to the hook member.
Figure 8:
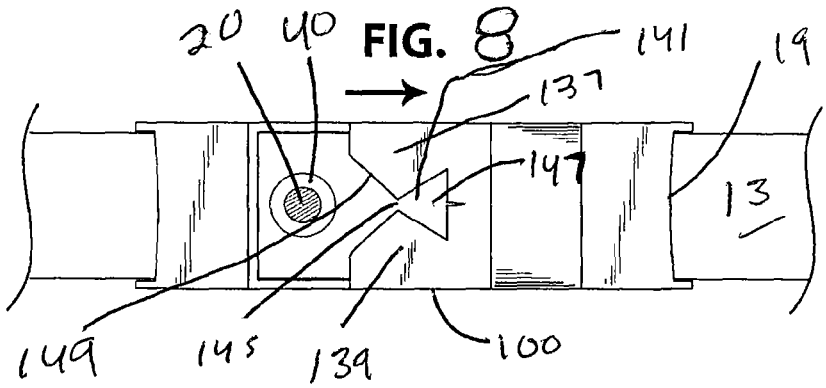
FIG. 8 is a cross-sectional top plan view showing the hook member in a disengaged position relative to the top sizer.
Figure 9:
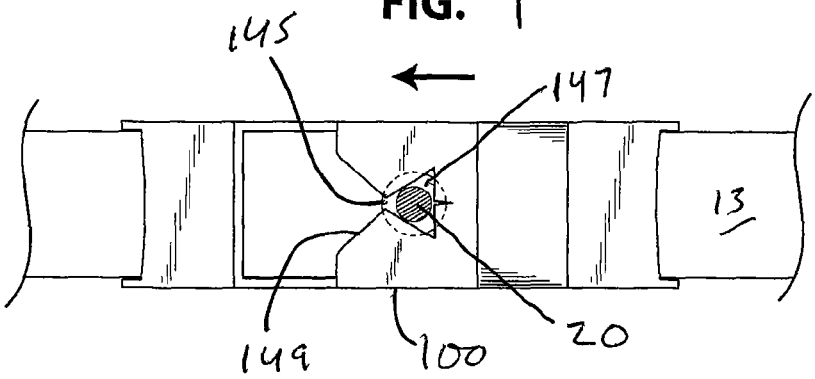
FIG. 9 is a cross-sectional top plan view of the top sizer locked in place relative to the hook member.

FIGS. 10 and 11 show a top sizer similar to the top sizer 100 of FIGS. 1-9 with the exception that the hook member 20 is sized so as to be frictionally held between the locking tabs 137, 139 instead of having a degree of movement in the inner space 147. The frictional holding of the hook member 20 is described in more detail with reference to the embodiment in FIGS. 12 and 13.

Figure 12:
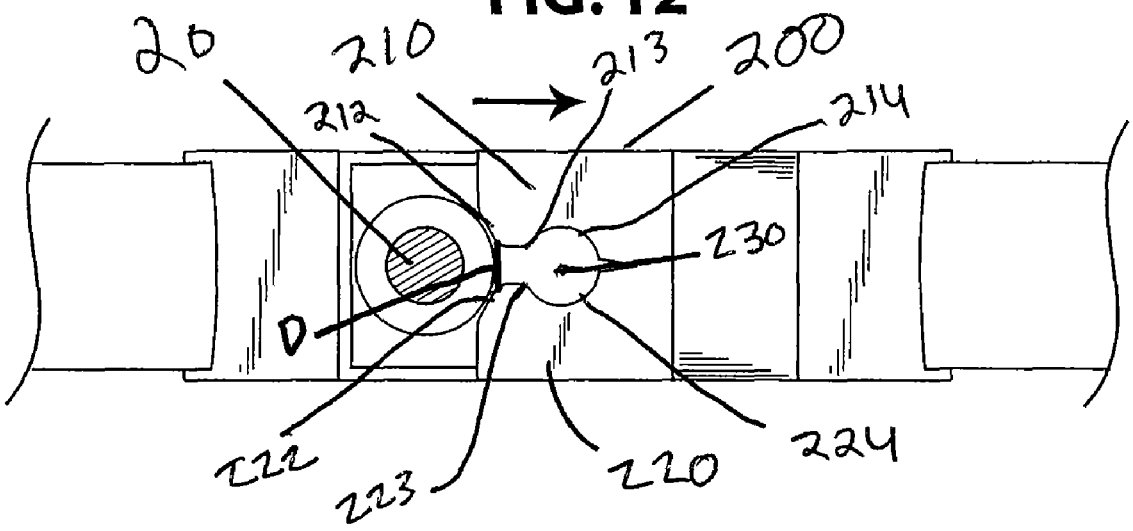
FIG. 12 is a cross-sectional top plan view showing the hook member in a disengaged position relative a top sizer according to another embodiment.
Figure 13:
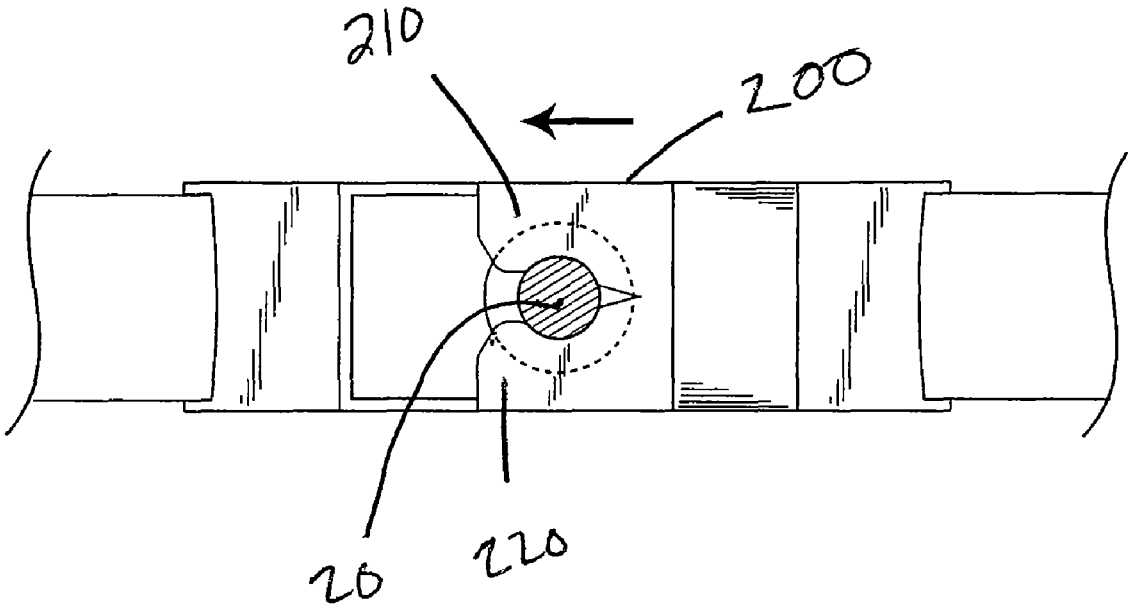
FIG. 13 is a cross-sectional top plan view of the top sizer of FIG. 12 locked in place relative to the hook member.

FIGS. 12 and 13 show a top sizer 200 according to another embodiment. The top sizer 200 is similar to the top sizer 100 in that the top sizer 200 is constructed to be releasably engaged and interlocked with the hook member 20. More specifically, locking tabs 210, 220 of the top sizer 200 have construction slightly different from the locking tabs 137, 139 resulting in the hook member 20 being retained and captured in a slightly different manner. Instead of having a more pronounced reverse taper construction as is the case for the locking tabs 137, 139, the locking tabs 210, 220 have a more rounded shape.

The locking tab 210 is defined by a front edge 212 that extends inward to a rounded inner portion 213 where the locking tab 210 then has an arcuate section 214 that extends toward the end of the body 110. Similarly, the locking tab 220 is defined by a front edge 222 that extends inward to a rounded inner portion 223 where the locking tab 220 then has an arcuate section 224 that extends toward the end of the body 110. The same portions of the locking tabs 210, 220 face one another such that the front edges 212, 222 are opposite one another; the inner portions 213, 223 face one another, and the arcuate sections 214, 224 face one another with a slot, opening or space 230 being formed therebetween. Since the two arcuate sections 214, 224 are opposite one another, a substantially circular opening is defined thereby and is intended to receive the hook member 20 as discussed below.

A distance D is defined between the front edges 212, 222 and represents the entrance into the space 230 that is defined between the two arcuate sections 214, 224. The distance D is slightly less than the width (diameter) of the hook member 20 such that the hook member 20 can not freely enter the space 230. In order for the hook member 20 to enter the space 230, the biasing force of the locking tabs 210, 220 must be overcome and in other words, a sufficient force must be applied to cause the locking tabs 210, 220 to separate so as to increase the distance D a sufficient distance greater than the width of the hook member 20.

Once the locking tabs 210, 220 separate from one another under the force of the hook member 20 being directed toward the space 230, the hook member 20 enters the space 230. Since in this embodiment, the hook member 20 occupies a substantial portion of the space 230 and unlike the embodiment shown in FIGS. 1-9, the hook member 20 is frictionally held and retained in the space 230 by being in intimate contact with the two locking tabs 210, 220. In other words, the locking tabs 210, 220 supply a biasing force against the hook member 20 so as to effectively hold the hook member 20. Unlike the other embodiment, the hook member 20 does not freely move within the space 230 when it is frictionally held by the locking tabs 210, 220 but instead is frictionally held tightly between the locking tabs 210, 220 and in particular, between the opposing arcuate sections 214, 224. The inward biasing force of the two locking tabs 210, 220 is sufficient to hold the hook member 20 in place and prevent the hook member 20 from becoming dislodged from the space 230.

The arcuate nature of the space 230 complements the circular shape of the hook member 20 and permits the hook member 20 to be effectively cradled or nested within the space 230 as it is being frictionally clamped by the two locking tabs 210, 220.

As with the other embodiment, the top sizer 200 is securely held in place and is interlocking engaged with the hook member 20 so as to prevent the top sizer 200 from freely moving or being removed from the hanger 10.

In order the remove the top sizer 200 from the hanger 10, the user simply moves the top sizer 200 along the upper edge 13 in a direction away from the hook member 20 so as to cause the hook member 20 to apply an outward force to the inner surface of the front edges 212, 222 resulting in the locking tabs 210, 220 separating from one another. As the locking tabs 210, 220 separate from one another, the distance between the front edges 212, 222 increases and this allows the hook member 20 to travel from the space 130 into the space (entrance) between the opposing front edges 212, 222 and then the hook member 20 can be free and disengaged from the locking tabs 210, 220.

Unlike the earlier embodiment where the top sizer 100 is captured within the inner space formed between the locking tabs, the top sizer 200 is frictionally held between and in intimate contact with the locking tabs.

While exemplary drawings and specific embodiments of the present invention have been described and illustrated, it is to be understood that the scope of the present invention is not to be limited to the particular embodiments discussed. Thus, the embodiments shall be regarded as illustrative rather than restrictive, and it should be understood that variations may be made in those embodiments by workers skilled in the art without departing from the scope of the present invention as set forth in the claims that follow, and equivalents thereof. In addition, the features of the different claims set forth below may be combined in various ways in further accordance with the present invention.

What is claimed is:

1. A top sizer for use with a garment hanger comprising: a hollow body having an open bottom and a top wall that has a first opening formed therein that provides communication to a hollow interior and a locking feature associated therewith and formed above at least a portion of the first opening, the first opening being defined by a sidewall of the hollow body and has an area that is greater than a cross-sectional area of a hook member of the garment hanger to permit lateral movement of the hook member within the area, wherein the locking feature has a slot that defines a pair of opposing resilient locking tabs, the slot being defined by an open end portion and an inner portion that has a width greater than the open end portion, with the slot being in communication with the first opening by means of an entrance defined by ends of the locking tabs to permit the hook member of the garment hanger that is in the first opening outside of the locking tabs to be received into the open end of the slot and then into the inner portion once a biasing force of the locking tabs is overcome resulting in the hook member being captured in the inner portion and the top sizer being locked relative to the garment hanger, wherein the entrance to the slot that is defined between the locking tabs has a varying width as measured from the first opening to the open end portion of the slot.

2. The top sizer of claim 1, wherein the body has two opposing side walls and two opposing end walls each that is joined to the top wall at an upper edge thereof, the top wall partially enclosing the body so as to define the hollow body.

3. The top sizer of claim 1, wherein the locking feature protrudes above and is integrally attached to the top wall.

4. The top sizer of claim 1, wherein each locking tab has a reverse tapered structure in an end portion thereof and the reverse tapered structures of the pair of locking tabs define a minimum width of the slot.

5. The top sizer of claim 1, wherein an inner closed end of the slot has a slit and the inner portion of the slot is substantially triangularly shaped.

6. The top sizer of claim 1, wherein the locking tabs define a top wall of the locking feature.

7. The top sizer of claim 1, wherein the locking tabs are elongated fingers that extend across a length of the locking feature toward an edge of the first opening.

8. The top sizer of claim 1, wherein the inner portion of the slot is defined an end wall that is substantially parallel to upper edges of the end walls of the body, the slot having a maximum width at the end wall of the inner portion of the slot.

9. The top sizer of claim 1, wherein the locking feature is formed above the top wall and the first opening such that the slot is in communication with the first opening and the hollow interior of the body.

10. The top sizer of claim 1, wherein lower edges of the end walls of the body have arcuate shapes.

11. The top sizer of claim 10, wherein the lower edges are convex shaped to permit the top sizer body to seat flush against the upper edge of the garment hanger which has a complementary arcuate shape.

12. The top sizer of claim 1, wherein a side wall of the locking feature lies in the same plane and is integrally attached to a side wall of the body.

13. The top sizer of claim 1, wherein the locking tabs have inwardly beveled edges at their free ends.

14. A top sizer for use with a garment hanger comprising: a hollow body having an open bottom and a top wall that has a first opening formed therein that provides communication to a hollow interior and a locking feature associated therewith and formed above at least a portion of the first opening, wherein the locking feature has a slot that defines a pair of opposing resilient locking tabs, the slot being defined by an open end portion and an inner portion that has a width greater than the open end portion, with the slot being in communication with the first opening to permit a hook member of the garment hanger that is in the first opening outside of the locking tabs to be received into the open end of the slot and then into the inner portion once a biasing force of the locking tabs is overcome resulting in the hook member being captured in the inner portion and the top sizer being locked relative to the garment hanger, wherein the free ends of the locking tabs are inwardly beveled ends and the inner portion of the slot is defined by inner edges that are outwardly beveled, the inwardly beveled ends and the inner edges meeting at a point that defines a minimum width of the slot.

15. A top sizer for use with a garment hanger comprising: a hollow body having an open bottom and a top wall that has a first opening formed therein that provides communication to a hollow interior and a locking feature associated therewith and formed above at least a portion of the first opening, wherein the locking feature has a slot that defines a pair of opposing resilient locking tabs, the slot being defined by an open end portion and an inner portion that has a width greater than the open end portion, with the slot being in communication with the first opening to permit a hook member of the garment hanger that is in the first opening outside of the locking tabs to be received into the open end of the slot and then into the inner portion once a biasing force of the locking tabs is overcome resulting in the hook member being captured in the inner portion and the top sizer being locked relative to the garment hanger, wherein the locking feature extends less than a full length of the top wall so as to expose an open end portion of the first opening that is configured to receive the hook member such that the hook member is initially disposed adjacent free ends of the locking tabs prior to lockingly engaging the hook member to the locking feature.

16. A top sizer for use with a garment hanger comprising: a hollow body having an open bottom and a top wall that has a first opening formed therein that provides communication to the hollow interior and a locking feature associated therewith and in communication to the hollow interior and a locking feature associated therewith and in communication with the first opening, the first opening being a completely bounded opening that is enclosed at one end by the locking feature and at an opposite end by an end wall of the hollow body, the first opening defining a space that is larger than a width of a hook member of the garment hanger to permit reception and free movement of the hook member in the bounded first opening that is adjacent the locking feature, wherein the locking feature has a slot that defines a pair of opposing resilient locking members, the slot having an entrance where a width of the slot is at a minimum and an inner portion where a width of the slot is at a maximum, the slot being in communication with the first opening to permit the hook member of the garment hanger that is initially received in the first opening and the space defined thereby adjacent the locking feature to be received into the entrance of the slot and then into the inner portion once the locking member are separated a sufficient distance at the entrance to permit reception of the hook member into the inner portion where it is captured due to the locking members flexing inward once the hook member passes through the entrance of the slot and into the inner portion.

17. The top sizer of claim 16, wherein the resilient locking members are in the form of elongated locking fingers each of which is integrally joined to a respective side wall of the body along one side edge thereof.

18. The top sizer of claim 17, wherein the elongated locking fingers are integrally formed with the side walls of the body such that an outer side edge thereof is contained in the same plane that includes the side wall of the body.

19. The top sizer of claim 16, wherein a width of the hook member is greater than the minimum width of the slot and is less than the maximum width of the slot.

20. A top sizer for use with a garment hanger comprising: a hollow body having an open bottom and a top wall that has a first opening formed therein that provides communication to a hollow interior and a locking feature associated therewith and formed above at least a portion of the first opening, wherein the locking feature has a slot that defines a pair of opposing resilient locking tabs, the slot being defined by an open end portion, an intermediate portion, and an inner portion, the intermediate portion having a width that is less than each of the open end portion and the inner portion, the slot being in communication with the first opening to permit a hook member of the garment hanger that is in the first opening outside of the locking tabs to be received into the open end of the slot and then into the inner portion once a biasing force of the locking tabs in the intermediate portion, where a width of the slot is at a minimum, is overcome resulting in the hook member being captured in the inner portion and the top sizer being locked relative to the garment hanger.

* * * * *